United States Patent [19]

Draper et al.

[11] Patent Number: 4,470,271

[45] Date of Patent: Sep. 11, 1984

[54] OUTDOOR UNIT CONSTRUCTION FOR AN ELECTRIC HEAT PUMP

[75] Inventors: Robert Draper; Robert S. Lackey, both of Pittsburgh, Pa.

[73] Assignee: Westinghouse Electric Corp., Pittsburgh, Pa.

[21] Appl. No.: 461,796

[22] Filed: Jan. 28, 1983

[51] Int. Cl.[3] ..... F25D 23/12

[52] U.S. Cl. ..... 62/259.1; 62/324.1; 165/124; 165/126

[58] Field of Search ..... 62/324.1–324.6, 62/325, 259.1, 518, 498, 531; 165/124, 126

[56] References Cited

U.S. PATENT DOCUMENTS

| | | | |
|---|---|---|---|
| 2,401,918 | 6/1946 | Elder et al. | 165/122 |
| 2,584,442 | 2/1952 | Frie | 165/126 |
| 3,289,428 | 12/1966 | Haines | 62/324.4 X |
| 3,305,006 | 2/1967 | Daltry | 165/124 |
| 3,707,185 | 12/1972 | Modine et al. | 165/111 |
| 3,766,750 | 10/1973 | Aoh et al. | 62/259.1 |
| 3,768,553 | 10/1973 | Sollich | 165/120 |
| 4,232,729 | 11/1980 | Ingram et al. | 165/39 |
| 4,261,418 | 4/1981 | Helt et al. | 62/324.1 X |
| 4,274,481 | 6/1981 | Ireland et al. | 165/122 |

*Primary Examiner*—Lloyd L. King
*Attorney, Agent, or Firm*—E. C. Arenz

[57] ABSTRACT

The outdoor unit for an electric heat pump is provided with an upper portion 10 containing propeller fan means 14 for drawing air through the lower portion 12 containing refrigerant coil means 16 in the form of four discrete coils connected together in a subassembly forming a W shape, the unit being provided with four adjustable legs 64 which are retracted in shipment, and are adjusted on site to elevate the unit to a particular height suitable for the particular location in which the unit is installed.

7 Claims, 4 Drawing Figures

OUTDOOR UNIT CONSTRUCTION FOR AN ELECTRIC HEAT PUMP

GOVERNMENT CONTRACT

The Government has rights in this invention pursuant to Prime Contract No. W-7405-ENG-26 and Subcontract No. 86X-24712-C awarded by the U.S. Department of Energy.

BACKGROUND OF THE INVENTION

This invention pertains to the construction of an outdoor unit for an electric heat pump of a size and character typically useable for residential conditioning.

The construction arrangement of this invention arose from a project to provide an electric heat pump particularly adapted for use in Northern climates, and one in which higher efficiencies are obtained in the heating mode of the unit. Since higher heating efficiencies are available with the refrigerant compressor placed indoors, as is known in the art, the compressor is omitted from the outdoor unit which permits various objectives of the outdoor unit to be more easily obtained. As such, the outdoor unit of this invention is of a construction which is considered to most nearly satisfy the combined requirements of performance, manufacturability, maintainability and, of course, marketability. These objectives are obtained with the unit of the invention through the provision of various features which will be explained in some detail hereinafter.

SUMMARY OF THE INVENTION

In accordance with the invention the outdoor unit construction includes a lower portion containing refrigerant coil means, an upper portion containing fan means for drawing air through the coil means and discharging it upwardly, the refrigerant coil means in the preferred form comprising four fin and tube coils connected together in a subassembly to form a W-shape as viewed in vertical cross-section, with the fins of the coils being disposed generally vertically, the unit being of generally rectangular shape as viewed in horizontal cross-section and having vertically adjustable leg means at each corner of the unit. Additionally, the fan means is reversible during a defrost cycle.

DESCRIPTION OF THE PREFERRED EMBODIMENT

Figure 1:
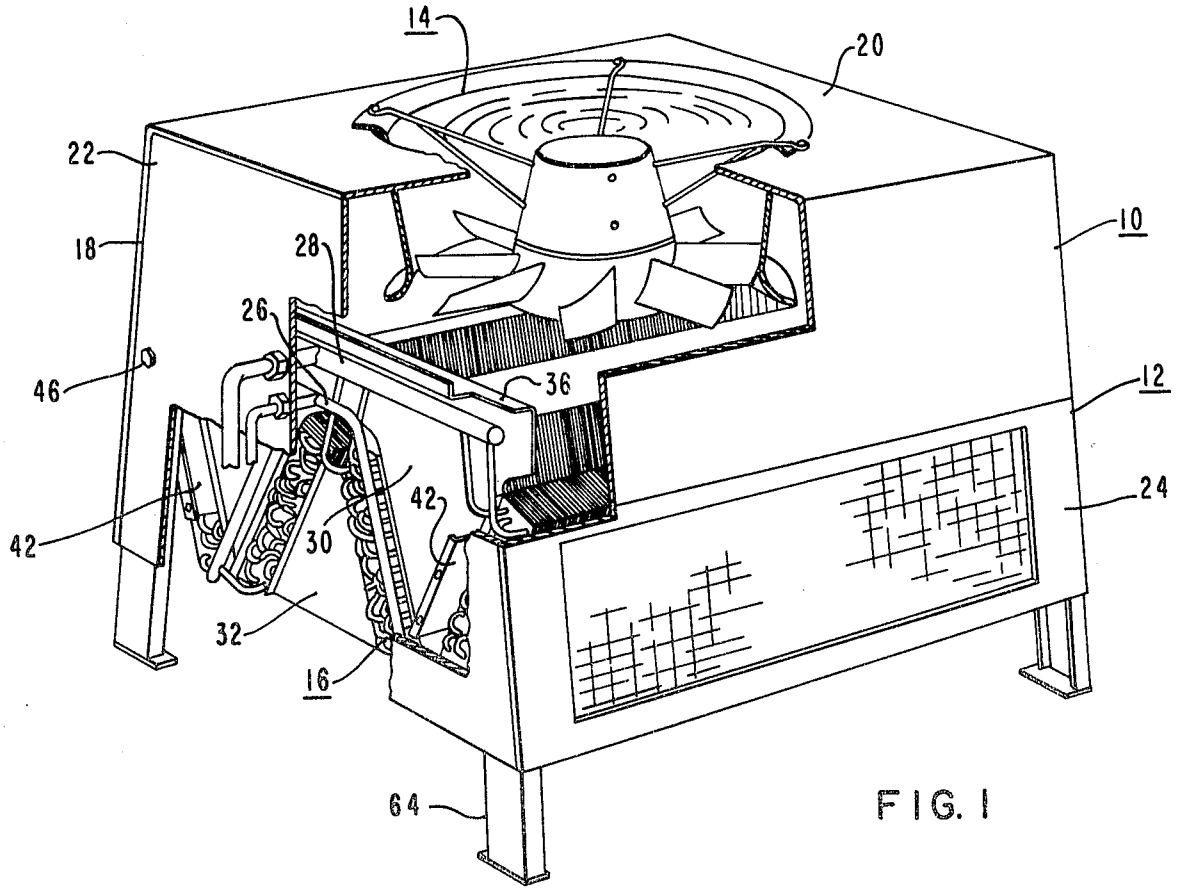
FIG. 1 is a partly broken isometric view of the outdoor unit according to the invention.

Referring to FIG. 1, the outdoor unit includes two main portions, the upper portion generally designated 10 and the lower portion generally designated 12. The upper portion contains fan means generally designated 14 while the lower portion contains the refrigerant coil means subassembly generally designated 16.

The cabinet means for the unit includes a pair of opposite end panels 18 and an inverted U-shaped panel which forms the top 20 and includes downwardly extending opposite side panels 22 having lower edges which terminate at a level generally corresponding to the level of the top edge of the coil means. A pair of openwork panels 24 cover the remaining lower portion of the opposite sides.

Figure 2:
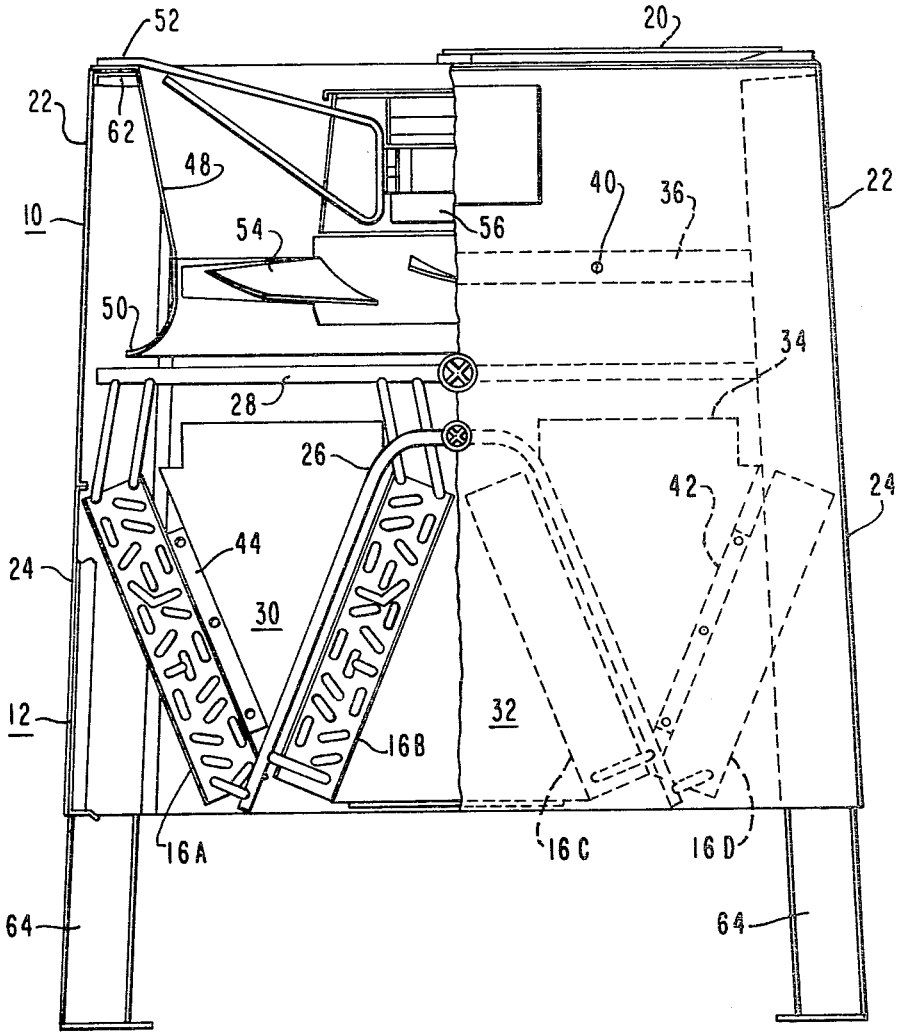
FIG. 2 is a partly broken end view of the unit.

Referring to FIGS. 1 and 2, the refrigerant coil means comprises four separate fin and tube coils 16A, 16B, 16C, and 16D, connected together in a subassembly to form a W-shape as is readily apparent from the views in FIGS. 1 and 2. These coils extend in an end-wise direction with the tubes thereof being generally horizontally disposed, and the fins of each coil being generally vertically disposed. This is not intended to preclude a slight inclination of the tubes from the horizontal and the fins from the vertical in accordance with the teachings in U.S. patent application Ser. No. 474,934 filed Mar. 14, 1983. A refrigerant liquid header 26 and a refrigerant gas header 28 are both provided at the one end of the unit and function to supply and receive refrigerant in accordance with the particular mode of operation of the heat pump.

Figure 3:
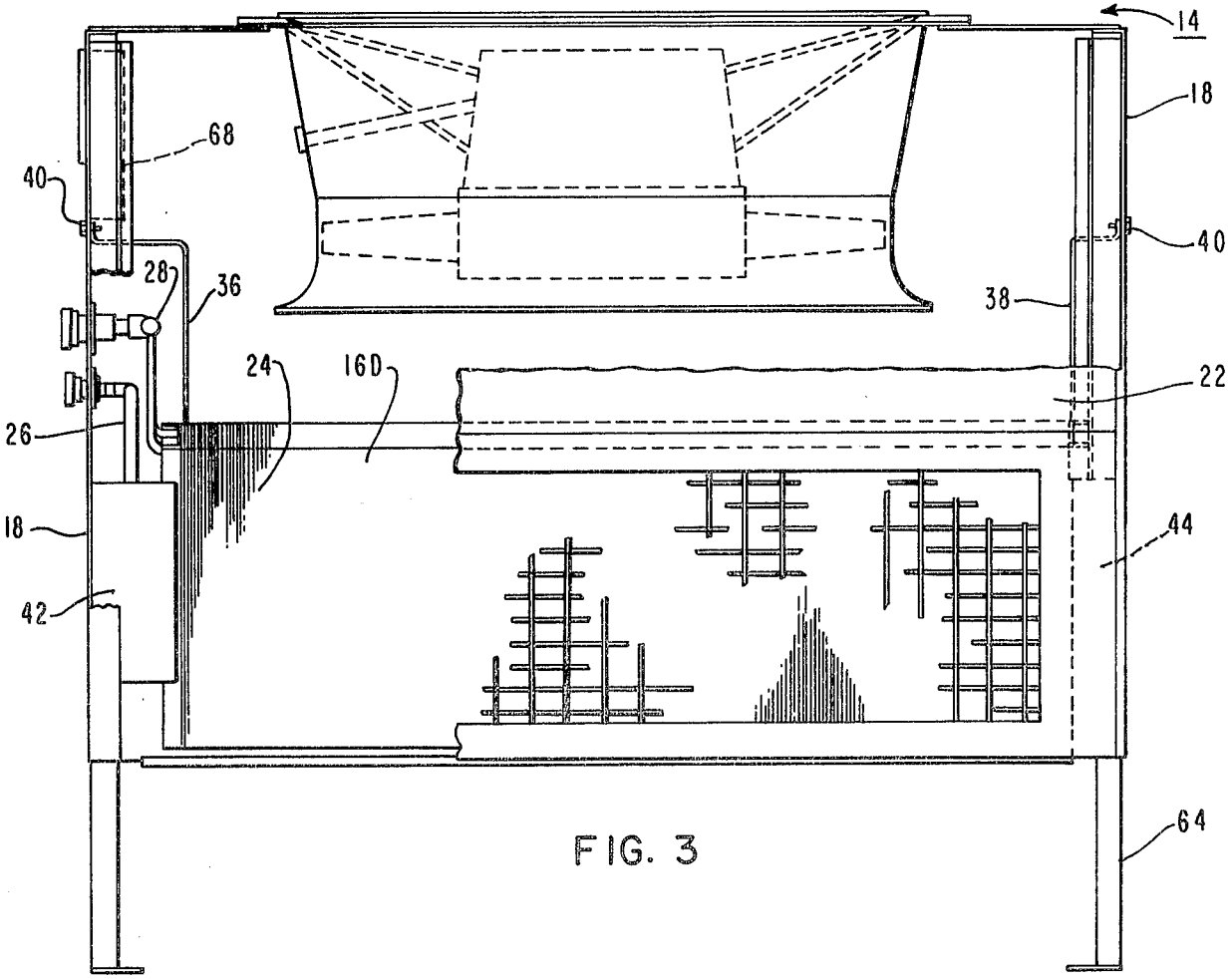
FIG. 3 is a partly broken side view of the unit.
Figure 4:
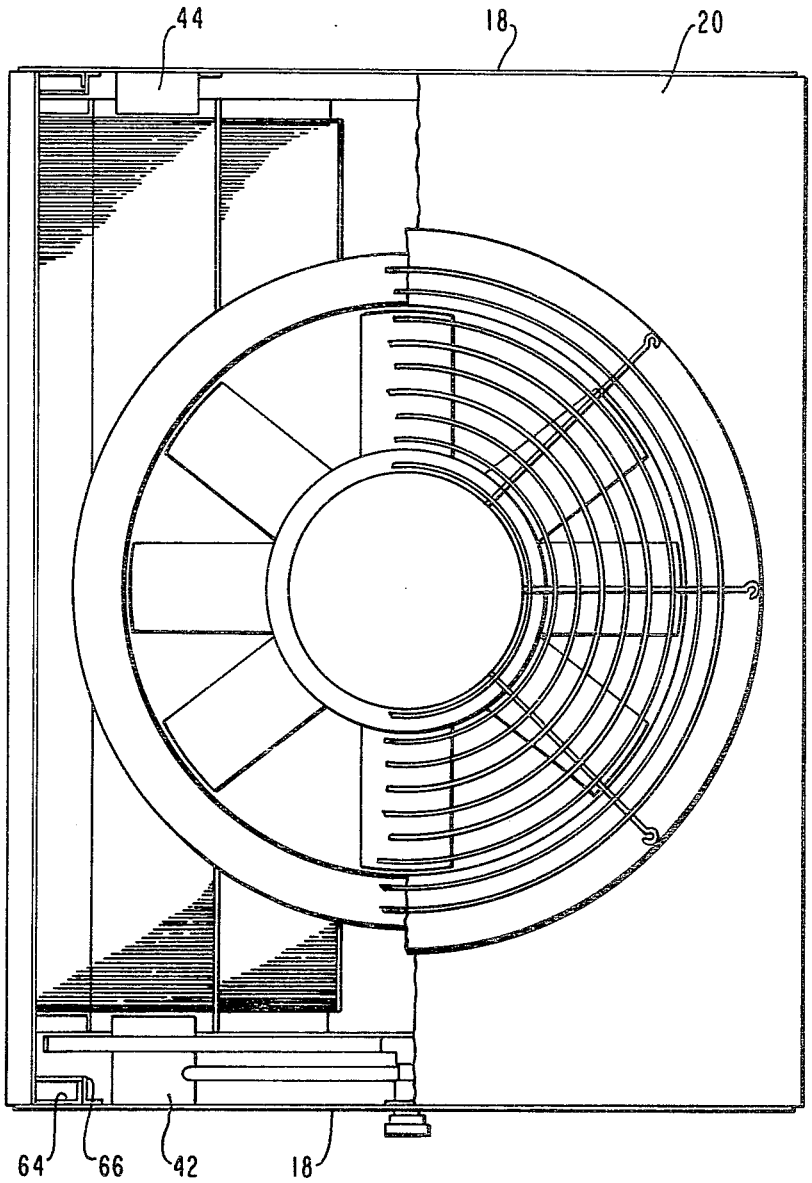
FIG. 4 is a partly broken top view of the unit.

The four coils 16A–D are connected together in a subassembly by providing three triangular sheet metal parts 30, 32, and 34, at each end of the coils, and securing these parts to the coil end frame. As a subassembly, the coils can be bench tested prior to installation in the unit. The upper edges of the triangular baffles 30 and 34 are connected to the lower edge of L-shaped baffles 36 and 38 (FIGS. 2 and 3), the upper legs of which are flanged and secured as with sheetmetal screws 40 to the end panels 18 of the unit. The opposite ends of the subassembly are also supported by one pair of support brackets 42 at one end of the assembly and another pair 44 at the other end of the assembly, these brackets having their inner edges secured to the coil end frames of coils **16*a* and 16*d*, and their outer flanged portions secured to the unit end panels 18 as by sheetmetal screws 46**.

The fan means 14, as in the case of the coil means subassembly, is also built as a subassembly to facilitate its installation in the unit. The fan means includes a generally cylindrical duct 48 having a rounded entrance 50 and terminating at the top with an outwardly directed flange 52. The fan impeller 54 is of the propeller type and is driven from the motor 56 carried by spider struts 58 having their outer radial ends overlying the duct flange 52. The top 20 of the cabinet is provided with an opening 60 down through which the fan means subassembly is installed in the cabinet with the outwardly directed flange of the duct seating on the margin 62 surrounding the opening. The airflow through the fan, when in any mode of operation other than defrost, is in an upper direction, with the airflow through the four individual coils being indicated by the directional arrows in FIG. 2. The motor 56 is reversible and is operated in a reverse direction in a defrost operation so that the fan 54 discharges air downwardly. This aids in driving defrost melt off the fins and to disperse any snow from under and around the unit.

The bottom face of the cabinet is open and is supported at some height above the ground or surface upon which the unit is mounted by the four adjustable legs 64, one at each corner of the cabinet. Thus the airflow to the two coils 16B and 16C is through the gap below the cabinet and the airflow to the two outside coils 16A and 16D is for the most part through the openwork panels 24. The legs 64 are adjustably received in generally vertically extending sockets 66 provided inside the cabinet at each of the four vertically disposed corners.

An electrical wiring box 68 is provided inside the same end panel 18 through which the refrigerant lines extend. Thus all access for service is at the one end of the unit.

ADVANTAGES OF THE DESCRIBED CONSTRUCTION

A number of factors contribute to excellent drainage of the melted frost on the coils during the defrost cycle when the unit is operated in a heating mode. One factor is that the fins are in a generally vertical plane. Another factor is that the drainage distance of the melt along the fins is fairly short because of the use of the four coils rather than a lesser number of coils providing the same coil face area. Also, with the W shape, the melt can disengage from the plurality of lower edges provided by that shape.

The elevation of the cabinet and the coil to at least a minimum distance from a lower surface, such as at least 6 or 7 inches (0.15 or 0.18 m), results in the coil being well above any surface which would provide a base for the buildup of ice formed after the melt disengages from the coil. Thus, crushing of the lower parts of the coil by ice buildup is avoided.

Since the coil is protected by the openwork grille and the outer coils 16A and 16D are inclined as shown so the coils do not form a part of the exterior surface of the unit, drifting snow and blown debris, such as leaves, cannot lie against the coil surface and cause blockage of the airflow. Further, the possibility of direct impingement of rain upon the coil surface and freezing thereon is relatively unlikely.

By virtue of the adjustability of the support legs, which are set on site to give anywhere between say 7 to 24 inches (0.15 to 0.61 m) of open clearance, the legs can be set in accordance with anticipated depth of snowfall in a given locality. The adjustability of the legs also permits the unit to be adapted to an unlevel site.

Since the coils do not form a part of the exterior surface of the unit, they are substantially immune from damage by objects which might strike the openwork structures. In units in which the exterior surface of the coil abut an openwork protective screen, crushing of fins and resulting loss of good contact between fins and tubes can occur.

The full retractability of the support legs permits the unit to be shipped in a smaller container than if the legs were fixed at some given height.

For a given capacity and efficiency the unit is relatively compact; in part because of the W coil configuration as contrasted to units with lesser numbers of discrete coils and the same coil face area.

Since the unit construction is relatively simple, and uses slab coils as distant from coils which require bending, relatively low manufacturing costs should be attainable with the unit.

Also, the unit is considered to provide relatively easy accessibility for maintenance.

We claim:

1. An outdoor unit construction of an air-to-air electric heat pump comprising:

a lower portion containing refrigerant coil means operable as an evaporator in the heating mode of said pump, and as a condenser in the cooling mode of said pump;

an upper portion containing fan means overlying said coil means for drawing air through said coil means and discharging the air upwardly in both modes of operation;

said refrigerant coil means comprising four fin and tube coils connected together in a subassembly to form an upright W as viewed in vertical cross-section, the fins of said coils being disposed generally vertically.

2. A unit construction of claim 1 wherein:

said unit is of generally rectangular shape as viewed in horizontal cross-section; and vertically adjustable leg means are provided at each corner to elevate the coil means at least a certain distance above the ground.

3. A unit construction according to claim 2 wherein:

said coils extend in an end-wise direction in said unit;

said unit has outer cabinet means comprising a pair of opposite end panels, an inverted U-shaped panel forming the top and extending down the opposite sides to a level generally corresponding to the top edge of said coils, and a pair of opposite openwork panels covering the remaining lower portion of the opposite sides.

4. A unit construction according to claim 3 wherein:

said U-shaped panel top includes an opening therein; and said fan means comprises a subassembly including a rounded-entrance duct with an outwardly flanged upper edge, and a propeller fan and motor carried therein; and said outwardly flanged upper edge is dimensioned to seat upon the margin around said top opening.

5. A unit construction according to claim 2 including:

means forming vertically extending sockets at each of the vertically disposed corners of said cabinet;

said leg means being received in each of said sockets and having length dimensions to accommodate substantially complete retraction of said leg means in said sockets.

6. A unit according to claim 3 wherein:

said refrigerant coil subassembly includes seal plate means between the ends of said coils at both of the opposite ends of said subassembly; and means connecting said seal plate means to said cabinet end panels to support said subassembly in said cabinet.

7. An outdoor unit for an air-to-air electric heat pump, comprising:

a lower portion containing refrigerant coil means operable as an evaporator in the heating mode of said pump, and as a condenser in the cooling mode of said pump, said refrigerant coil means comprising fin and tube coil means, the fins of said coil means being disposed generally vertically;

an upper portion containing an electric motor driving fan means overlying said coil means for normally drawing air through said coil means and discharging the air upwardly in both modes of operation;

vertically adjustable leg means elevating said unit at least a certain distance above the ground; and said electric motor being operable in a reverse direction in a defrost cycle so that said fan means discharges air downwardly to aid in driving defrost melt off said fins and to disperse blowable snow from below said unit.

* * * * *